United States Patent [19]

Müller et al.

[11] Patent Number: 4,597,752

[45] Date of Patent: Jul. 1, 1986

[54] PAPER STACKER FOR A PRE-FOLDED CONTINUOUS WEB WITH A VARIABLE-LENGTH GUIDE CHANNEL

[75] Inventors: Gerhard Müller, Taufkirchen; Hans Hahn, Unterhaching; Walter Tropschuh, Munich, all of Fed. Rep. of Germany

[73] Assignee: Siemens Aktiengesellschaft, Berlin & Munich, Fed. Rep. of Germany

[21] Appl. No.: 678,816

[22] Filed: Dec. 6, 1984

[30] Foreign Application Priority Data

Dec. 23, 1983 [DE] Fed. Rep. of Germany ..... 3346841

[51] Int. Cl.[4] ..... B31B 1/00

[52] U.S. Cl. ..... 493/410; 493/409

[58] Field of Search ..... 493/409, 410, 411, 412, 493/413, 414, 415; 414/28, 84, 87; 270/30, 39

[56] References Cited

U.S. PATENT DOCUMENTS 4,474,567 10/1983 Mugrauer et al. ..... 493/410

*Primary Examiner*—Francis S. Husar

*Assistant Examiner*—Robert Showalter

*Attorney, Agent, or Firm*—Hill, Van Santen, Steadman & Simpson

[57] ABSTRACT

A paper stacker for receiving a continuous web having prearranged longitudinally spaced lateral crease lines from a feed arrangement and laying the web down in a folded fashion at the lines to form a vertical stack on a stationary surface characterized by a piling device, guides for receiving the paper from the feed arrangement and guiding the web of paper to the piling device and a lifting device for elevating the piling device as the height of the stack increases. The guides are preferably formed by a pair of guide grids which face one another to provide a guide channel with each of the guide grids having individual guide members being positioned side-by-side and extending in a direction of movement of the web, each of the guide grids have an upper portion and a lower portion which are telescopically displaceable inside one another with the lower portion being connected to the pile device to move therewith and the upper portion being displaceably mounted on guide rods attached to the feed arrangement.

7 Claims, 2 Drawing Figures

PAPER STACKER FOR A PRE-FOLDED CONTINUOUS WEB WITH A VARIABLE-LENGTH GUIDE CHANNEL

BACKGROUND OF THE INVENTION

The present invention is directed to a paper stacker for receiving an endless paper web having prearranged longitudinally spaced laterally extending crease lines from a supply device such as a printer and laying the web down in a folded fashion at said crease lines to form a vertical paper stack on a stationary surface. The stacker includes a piling device for depositing the paper in a folded fashion in the stack on the stationary surface, a guide arrangement for receiving the paper from the supply device and guiding the web of paper to the piling device and a lifting arrangement including a drive motor for elevating the piling device as the height of the stack increases with the guide arrangement including guide members having a changeable length in response to movement of the pile device relative to the stationary surface.

A paper stacker, which has a piling device, a lifting arrangement for the piling device and a guide arrangement extending between the piling device and the source of paper such as a printer, are generally known and have been successfully employed. A paper stacker for a prefolded or precreased continuous form web is disclosed in U.S. Pat. No. 4,474,567 which claims priority from German OS No. 31 15 111. The U.S. patent discloses a paper stacker in which the paper deposit surface is stationary and the piling device or means together with a folding device is moved away from the stationary surface as the height of the paper stack increases. A paper guide arrangement, which has a channel that is formed by members whose lengths vary as the working height of the pile means changes, are provided between a paper feed or paper source and the pile means in order to prevent lateral excursion of the paper web while traveling therebetween. The paper guide channel can be designed as a collapsible and expandable guide channel which is independent of the movement of the deposit means.

When stacks of a continuous form have a high stack height, for example, a so-called "super pack" which has more than 3800 individual seats, are processed with such a paper stacker, an extremely great lift height is required for the pile means or device. With this great lift height, a great change in the variable length of the paper guide members and channels is required.

Paper guidance channels of this length are susceptible to malfunction and are difficult to manufacture. For example, on the one hand, they have an extreme length when a low stack is present and this will lead to disruption of the paper transport within the paper guidance channel or guide means. On the other hand, space problems can occur given paper stacks of a great height as a consequence of the telescopic paper guidance channels.

SUMMARY OF THE INVENTION

The object of the present invention is to provide a paper stacker which can handle stacks of continuous form that differ greatly in stack height without problems with disruption in the flow of the web being folded into the stack.

To accomplish these goals, the present invention is directed to an improvement in a paper stacker for receiving an endless paper web having prearranged longitudinally spaced lateral crease lines from a supply source or feed arrangement and laying the web down in a folded fashion at said crease lines to form a vertical paper stack on a stationary surface, said stacker including piler means for depositing the paper in a folded fashion in a stack on said stationary surface, guide means for receiving the paper from the supply device or feed means and guiding the web of paper to the piler means and lifting means including a drive motor for elevating the piler means as the height of the stack increases, said guide means including a guide channel having a changeable length in response to movement of the piler means relative to the stationary surface. The improvements comprise the guide means being a pair of guide lattices or grids facing each other to provide the guide channel with each of the guide lattices having individual guide members being positioned side-by-side and extending in the direction of movement of the web, each of said guide lattices having an upper portion and a lower portion telescopically displaceable inside one another, said upper portion being displaceably mounted on guide rods attached to the supply device or feed means and the lower portion being connected to the piler means to move therewith.

The upper lattice part or grid portion is displaceably connected on the guide rods by having support or connecting blocks connected to a hollow guide pipe having an end provided with a guide block slidably received on the guide rod against a bias means such as a coil spring. The support or connecting blocks of the upper lattice portion supports an adjustable detent which will engage or interact with a surface of the device to limit movement of the upper lattice portion in one direction. The lower lattice or grid portion has lower guide rods or elements which are telescopically received in the guide pipes of the upper portion and the lower guide element and guide pipes have coacting dogs or stops to prevent separation thereof. Each of the individual members of one of the upper and lower portions is a tubular member which telescopically receives a rod-like member of the other portion. At least one of these members is provided with a cable section to prevent disengagement of the rod-like members from the hollow or tubular members.

The paper guidance channel formed by the pair of guide lattices can automatically adapt to different stack heights of the paper stack with a particularly exact guidance of the continuously formed web because of the telescopically extensible lattices. Regions of exact guidance for the paper guidance channel are important for disruption-free stacking, namely, in the proximity of the deposit means. In addition, the telescoped lattices of the guide means can still be incorporated in existing apparatuses having a limited overall lattice height.

The overall device is not susceptible to malfunction and is constructed in an optionally reliable fashion.

DESCRIPTION OF THE PREFERRED EMBODIMENTS

Figure 1:
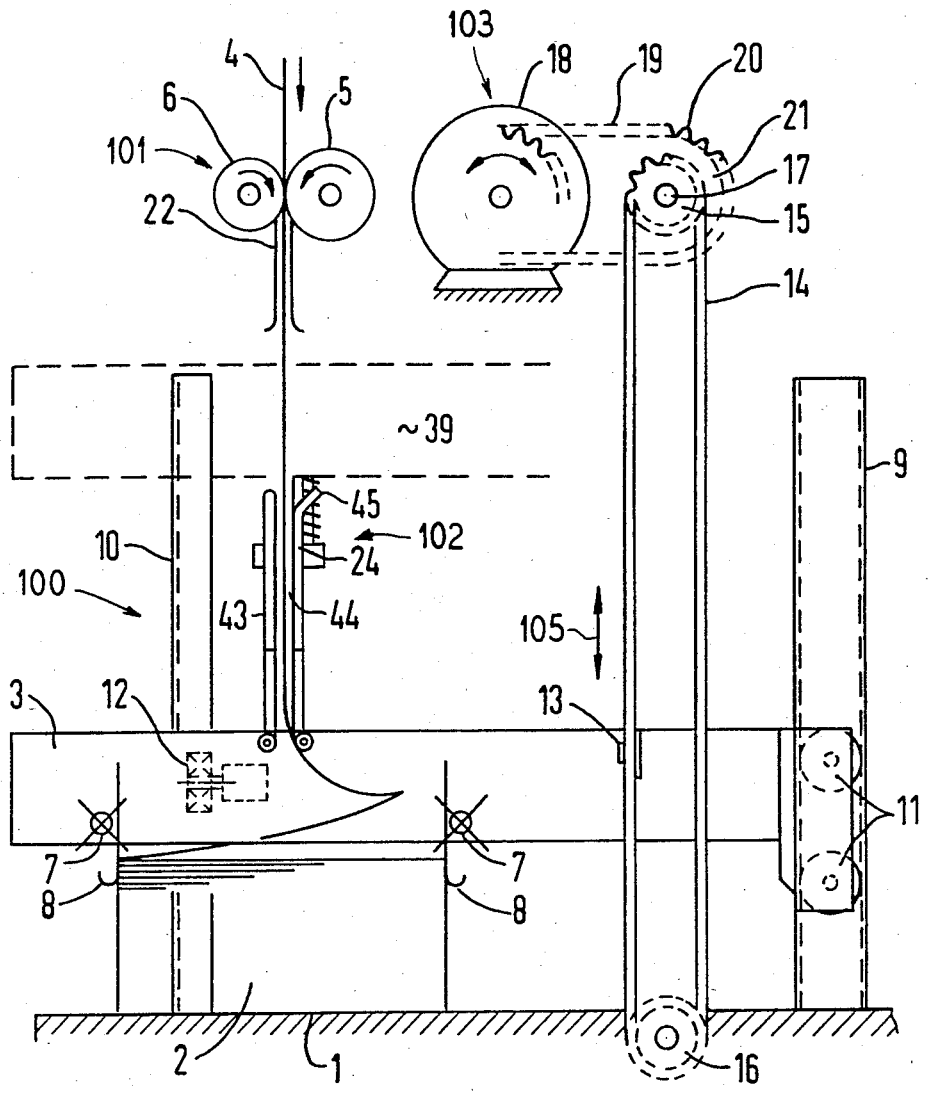
FIG. 1 is a schematic illustration of the paper stacker in a non-mechanical fast printer with parts shown in section.

The principles of the present invention are particularly useful in a paper stacker generally indicated at 100 in FIG. 1. The stacker 100 receives a web 4 from a feed means 101 of a device such as a printer and lays the web 4 down in a folded fashion at its crease lines to form a vertical paper stack 2 on a stationary deposit surface 1.

In FIG. 1, the printer device is only illustrated by a portion of its housing 39 shown in broken lines and the feed means 101. The feed means 101 includes drive rollers 5 which coact with pressure rollers 6 to move the web 4 in a vertical direction as illustrated by the arrow through a stationary paper guide 22 of the feed means.

The stacker 100 includes a deposit or piler means 3, a guide means 102 and lifting means 103. When the continuous paper web 4 is discharged from the feed means 101, it is received by the guide means 102 and transferred to the piler or deposit means 3 where the web is seized and folded along the prestamped or creased folds. The folding is assured, for example, by laterally attached paddle shafts 7 which coact with limiting rods 8 to guide the top portion of the stack as it is being placed in the stack 2.

The deposit means or piler means 3 is supported for movement along vertically extending guide rails or channels 9 and 10 which extend from the stationary surface 1 and are held by portions of the housing of the printing means which is not illustrated. The guide rails 9 and 10 coact with rollers such as 11 and 12 on a frame of the piler means 3 to guide the piler as it is moved in a vertical direction. The piler means 3 is supported for vertical movement by the lifting means 103. As illustrated, the lifting means 103 has two continuous chains 14, each of which are clamped to a side of the frame for the piler means by a clamp 13. Each of the continuous chains (only one illustrated) is supported for movement in a vertical direction as illustrated by the arrow 105 by a top sprocket 15 and a bottom sprocket 16. The top sprocket 15 is mounted on a shaft 17 that is common with the sprocket for the other chain and which is driven by a reversible electric motor 18 which has a suitable selective controllable armature stop brake. The motor 18 has an output gear which is connected by a drive chain 19 to a drive pinion 20 of a free-wheel 21 coupled for rotation with the shaft 17. The free-wheel 21 is constructed in a known manner having an inner ring which is rigidly connected to the shaft 17 such as, for example, by means of a feather key or one-way clutch and an outer ring which is rigidly connected to the pinion 20.

When the motor 18 is stopped, the free-wheel 21 is blocked by the dead weight of the piler means or device 3. In this manner, rotation of the shaft 17 is arrested and the piler 3 remains at the working height in the stacker which is assumed during stacking operations. By means of turning the motor 18 on, this working height of the piler can be changed in steps or in a continuous fashion so that the piler is raised upwardly over the growing stack 2 or lowered downwardly by virtue of the dead weight force of the piler acting on the inner ring of the free-wheel 21 depending upon the direction in which the motor 18 turns. Suitable limit switches may be arranged in the stacker 100 to control movement of the piler 3 upwardly or downwardly via an on/off control of the motor 18.

In accordance with the invention, the piler means 3 can also be manually lifted within the stacker 100 as desired. As the piler means 3 is manually lifted, tension on the continuous chains 14 is relieved and the clutch or key of the free-wheel 21 is released. The drive shaft 17 then turns without load beneath the outer ring of the free-wheel 21 regardless of whether or not the motor 18 is in a driving mode. This results in that the motor 18 is automatically uncoupled from the positive drive connection with the shaft 17 during lowering of the piler means 3. This uncoupling preferably occurs when the piler means 3 while being lowered, strikes against a suitable detent means (not shown) which leads to a relieving of the tension on the continuous chains 14 by virtue of the removal of the weight of the piler means 3 without requiring the motor 18 to be immediately shut off. It is noted that a more detailed description of the operation is contained in U.S. Pat. No. 4,474,567 and the disclosure of that patent is incorporated by reference thereto.

Figure 2:
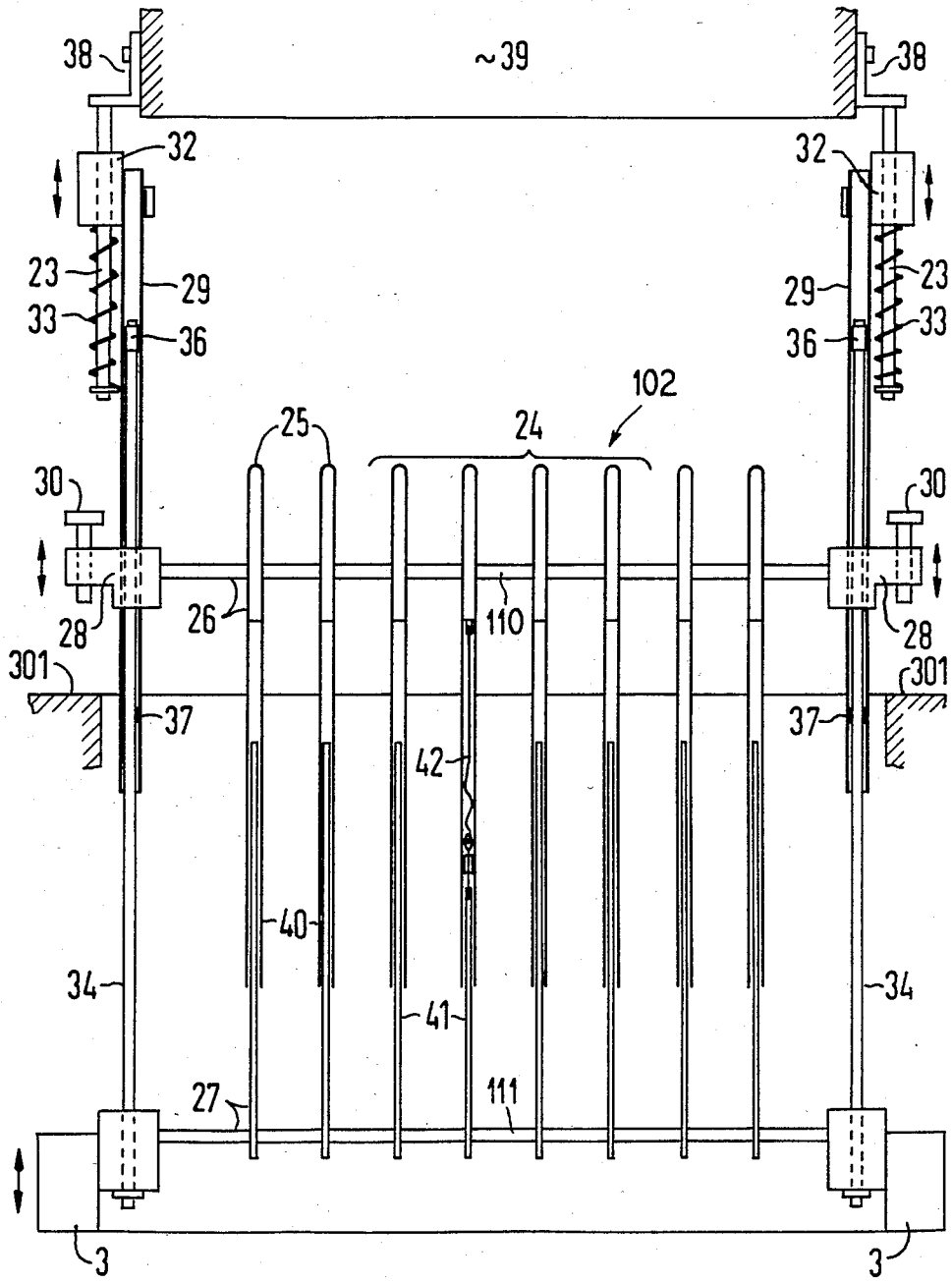
FIG. 2 is a schematic illustration of the variable length paper guidance channel of the paper stacker.

The changing working heights for the piler means 3 necessarily leads to varying the distance between the piler means 3 and the stationary standard paper guide 22 of the feed means 101. The stacker 100 includes the guide means 102 which has a variable length and is positioned between the stationary guide 22 of the feed means and the piler means 3. As illustrated in FIG. 1, this guide means 102 consists of a pair of guide lattices or grids 24 and 43 which form a changeable channel 44. The guide lattice 24 is vertically displaceable relative to guide rails or rods 23 (see FIG. 2) which are secured by fastening elements 38 to the housing portion 39 of the printer. The guide lattice 24 itself is formed of an upper lattice part or portion 26 and of a lower lattice part or portion 27 which portions are designed for telescopic displacement inside one another.

As illustrated, the upper lattice portion or part 26 includes individual members 25 which have tubular lower portions 40 and are supported side-by-side on a cross member 110. The cross member 110 at each end is provided with a support block 28 that is connected to a guide pipe or hollow member 29. In addition, the support block 28 also receives stop screws 30 which form adjustable detents that interact with stationary stop faces 301 which are part of the frame or housing of the printer. These stops thus limit the displacement range of the upper lattice part 26. Each of the guide pipes 29 are in turn connected at one end to sliding guide members, blocks or mounts 32 which are slidably received on the guide rods 23. The guide rods 23 include bias means such as a coil spring 33 to move the guide members 32 and their guide pipes 29 in an upward direction. Thus, the support blocks 28, guide pipes 29 and guide blocks 32 form means for displaceably connecting the upper portion 26 to the rods 23.

The lower lattice part 27 has rod members 34, which are telescopically received in the guide pipes 29. As illustrated, the ends of the rod member 34 have a rigid sleeve 36 which coacts with a detent stop or dog element 37 of the pipe 29 to prevent separation of the rod 34 from the pipe 29. The lower lattice part 27 also has a plurality of rod members or elements 41 which are spaced apart and slidably received within the tubular portion 40 of the members 25. The rod elements 41 are secured on a cross member 111 which is connected at its end to the rod members 34. In addition, it is noted that the lower lattice portion or part 27 is connected to a frame of the piler means 3.

In order to prevent an unintentional extension of the lattice and thus a separation of the upper lattice part 26 from the lower lattice part 27, an extension limitation means consisting of a cable section 42 is provided between one of the members 25 of the upper lattice part or portion 26 and a rod element of the lower portion 27. Preferably, the cable 42 is received in one of the tubular portions 40.

As may be seen from FIG. 1, the second guide lattice 43 is positioned relative to the guide lattice 24 with a given space to form the adjustable length of the channel 44. It is noted that the upper end of one of the guide lattices such as the guide lattice 24 has a bent portion 45 to form an entrance throat for receiving the web 4 as it is being threaded through the device.

The function of the guide means is as follows: When the piler means 3 is moved down at the initialization of the printer, then the upper lattice part 26 and the lower lattice part 27 can either move together or move separately. It is noted that because of the presence of the coil springs 33, the lower lattice part 27 will move relative to the upper lattice part 26 until the coacting stops formed by the sleeve 36 and the stop 37 prevent further separation. At this time, the upper lattice part will then move on the guide rods 23 against the force of the springs 33 until the stop detent 30 engages the stop surface 301 of the printing device. At this time, further movement of the guide means will be stopped. As the lifting means 103 raises the piler means 3, while the stack is being increased, the force of the springs 33 first push the upper lattice portion 26 to its uppermost position before there is relative movement between the upper and lower lattice parts.

Although various minor modifications may be suggested by those versed in the art, it should be understood that we wish to embody within the scope of the patent granted hereon, all such modifications as reasonably and properly come within the scope of our contribution to the art.

We claim:

1. In a paper stacker for receiving an endless paper web having prearranged longitudinal spaced lateral crease lines from a feed means of a device and laying the paper web down in a folded fashion at said crease lines to form a vertical paper stack on a stationary surface positioned below the feed means, said stacker including a frame, piler means located in said frame for depositing the paper web in a folded fashion in the stack on said stationary surface being movable in said frame from a lower position adjacent the stationary surface and an upper position, guide means attached to the piler means for receiving the paper web from the feed means and guiding the paper web to the piler means and lifting means connected to said piler means including a drive motor for elevating the piler means from the lower position toward the upper position as the height of the stack increases, said guide means including a guide channel having a changeable length in response to movement of the piler means relative to the stationary surface, the improvements comprising the guide means being a pair of guide lattices facing each other to provide the guide channel with each of the guide lattices having individual guide members being positioned side-by-side and extending in the direction of movement of the paper web, each of said guide lattices having an upper portion and a lower portion telescopically displaceable inside one another, means for displaceably mounting the upper portion of each guide lattice on guide rods attached to the feed means to enable the upper portion to move relatively to the feed means and the lower portion being connected to the piler means to move therewith.

2. In a paper stacker according to claim 1, wherein the means for displaceably mounting include a guide block slidably received on each of the guide rods and spring means urging the guide block in an upward direction, each of said guide blocks being connected to a guide pipe which in turn has a support block connected to a cross piece supporting the individual guide members of the upper portion of the guide lattice, each support block having a detent coacting with a stationary stop surface to limit the downward displacement of the upper portion, said lower portion having a rod member telescopically received in each of said guide pipes, said guide pipes and rod members having coacting dog elements to prevent disengagement of the rod member from the respective guide pipe.

3. In a paper stacker according to claim 2, wherein the detents of the support blocks are adjustable detents formed by threaded members.

4. In a paper stacker according to claim 2, wherein the individual guide members of the upper portion have lower tubular portions and the individual guide members of the lower portion are rod elements telescopically received in the tubular portions, and wherein limiting means comprising a cable section connects one rod element of the lower portion with the corresponding tubular portion of the upper portion to prevent disengagement of the rod element.

5. In a paper stacker according to claim 1, which includes means connected to said upper and lower portions to maintain engagement between the upper and lower portions.

6. A paper stacker for receiving an endless paper web having prearranged longitudinal spaced lateral crease lines from a feed means of a device and laying the paper web down in a folded fashion at said crease lines to form a vertical paper stack on a stationary surface positioned below the feed means, said stacker including a frame, piler means located in said frame for depositing the paper web in a folded fashion in the stack on said stationary surface being movable in said frame from a lower position adjacent the stationary surface and an upper position, lifting means connected to said piler means including a drive motor for moving the piler means in the frame between the lower position and the upper position so that as the height of the stack increases, the piler means is moved toward said upper position, and guide means having a guide channel for receiving the paper web from the feed means and guiding the paper web to the piler means, said guide means comprising a pair of guide lattices facing each other to provide the guide channel with each of the guide lattices having individual guide members being positioned side-by-side and extending in the direction of movement of the paper web, each of said guide lattices having an upper portion and a lower portion telescopically displaceable inside one another to change the length of the guide lattice with the maximum length being less than the distance between the feed means and piler means with the piler means in the lower position, the lower portion of each of the guide lattices being connected to the piler means to move therewith, and means for mounting the upper portion of each guide lattice for displacement along guide rods attached to the feed means to enable the upper portion to move relative to the feed means as the piler means is moved between said upper and lower positions.

7. A paper stacker according to claim 6, wherein the means for mounting include a guide block slidably received on each of the guide rods and spring means urging the guide blocks in an upward direction, each to the guide blocks being connected to a guide pipe which in turn has a support block connected to a cross piece supporting the individual guide members of the upper portion of the guide slattice and a detent being provided for each of the upper portion coacting with a stationary stop to limit the downward displacement of the upper portion as the piler means moves towards said lower position.

* * * * *